US008554109B2

(12) United States Patent
Fukuzawa et al.

(10) Patent No.: US 8,554,109 B2
(45) Date of Patent: Oct. 8, 2013

(54) IMAGE FORMING APPARATUS

(75) Inventors: Tsuneo Fukuzawa, Kanagawa (JP); Hiroki Ando, Kanagawa (JP); Satoshi Honobe, Kanagawa (JP); Toshiyuki Matsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 333 days.

(21) Appl. No.: 12/960,731

(22) Filed: Dec. 6, 2010

(65) Prior Publication Data

US 2011/0318054 A1 Dec. 29, 2011

(30) Foreign Application Priority Data

Jun. 28, 2010 (JP) ..... 2010-146976

(51) Int. Cl.
*G03G 15/00* (2006.01)

(52) U.S. Cl.
USPC ..... 399/117; 399/167

(58) Field of Classification Search
USPC ..... 399/167, 117
See application file for complete search history.

(56) References Cited

U.S. PATENT DOCUMENTS

| | | | | |
|---|---|---|---|---|
| 6,438,341 | B1 | 8/2002 | Matsuoka | |
| 2008/0069635 | A1 * | 3/2008 | Maehata et al. | 403/343 |

FOREIGN PATENT DOCUMENTS

| | | |
|---|---|---|
| JP | 2001-147618 | 5/2001 |
| JP | 2001-154564 | 6/2001 |
| JP | 2005-91793 | 4/2005 |

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

An image forming apparatus including plural image forming units each having an image-carrier includes: a cylindrical image-carrier body holding an image; a rotary shaft inserted in the image-carrier body, and rotatably supporting the image-carrier body; a coupling member fitted to an end portion of the rotary shaft, transmitting a rotational-drive-force to the rotary shaft; an engaging member projecting from a circumferential surface of the rotary shaft, being engaged to an engaged portion formed in the image-carrier body to disable relative rotation of the image-carrier body to the rotary shaft; and an attaching member continuously inserted into a first through hole formed in the coupling member and a second through hole formed in the rotary shaft and fixed thereto such that an angle formed between the engaging member and the attaching member is substantially 90 degrees as seen in an rotary shaft axial-direction, attaching the coupling member and the rotary shaft.

17 Claims, 7 Drawing Sheets

CIRCUMFERENTIAL VELOCITY FLUCTUATION OF PHOTORECEPTOR IN PRESENT EXEMPLARY EMBODIMENT

CIRCUMFERENTIAL VELOCITY FLUCTUATION OF PHOTORECEPTOR IN PRESENT EXEMPLARY EMBODIMENT (REVERSAL PIN PHASE AT 180 DEGREE)

IMAGE FORMING APPARATUS

CROSS-REFERENCE TO RELATED APPLICATION

This application is based on and claims priority under 35 USC 119 from Japanese Patent Application No. 2010-146976 filed Jun. 28, 2010.

BACKGROUND

1. Technical Field

The present invention relates to an image forming apparatus.

SUMMARY

An aspect of the invention is an image forming apparatus including plural image forming units each having an image carrier, the image carrier including: a cylindrical image carrier body on a surface of which an image is held; a rotary shaft that is inserted in the image carrier body, and that rotatably supports the image carrier body; a coupling member that is provided to be fitted to an end portion of the rotary shaft, and that transmits a rotational drive force from an apparatus body side to the rotary shaft; an engaging member that projects from a circumferential surface of the rotary shaft in directions opposite to each other, the engaging member being engaged to an engaged portion formed in the image carrier body so as to disable relative rotation of the image carrier body with respect to the rotary shaft; and an attaching member that is continuously inserted into a first through hole formed in the coupling member and a second through hole formed in the rotary shaft and is fixed thereto in such a manner that an angle formed between the engaging member and the attaching member is substantially 90 degrees as seen in an axial direction of the rotary shaft, the attaching member attaching the coupling member and the rotary shaft.

BRIEF DESCRIPTION OF THE DRAWINGS

An exemplary embodiment of the invention will be described in detail with reference to the following figures, wherein.

DETAILED DESCRIPTION

Figure 1:
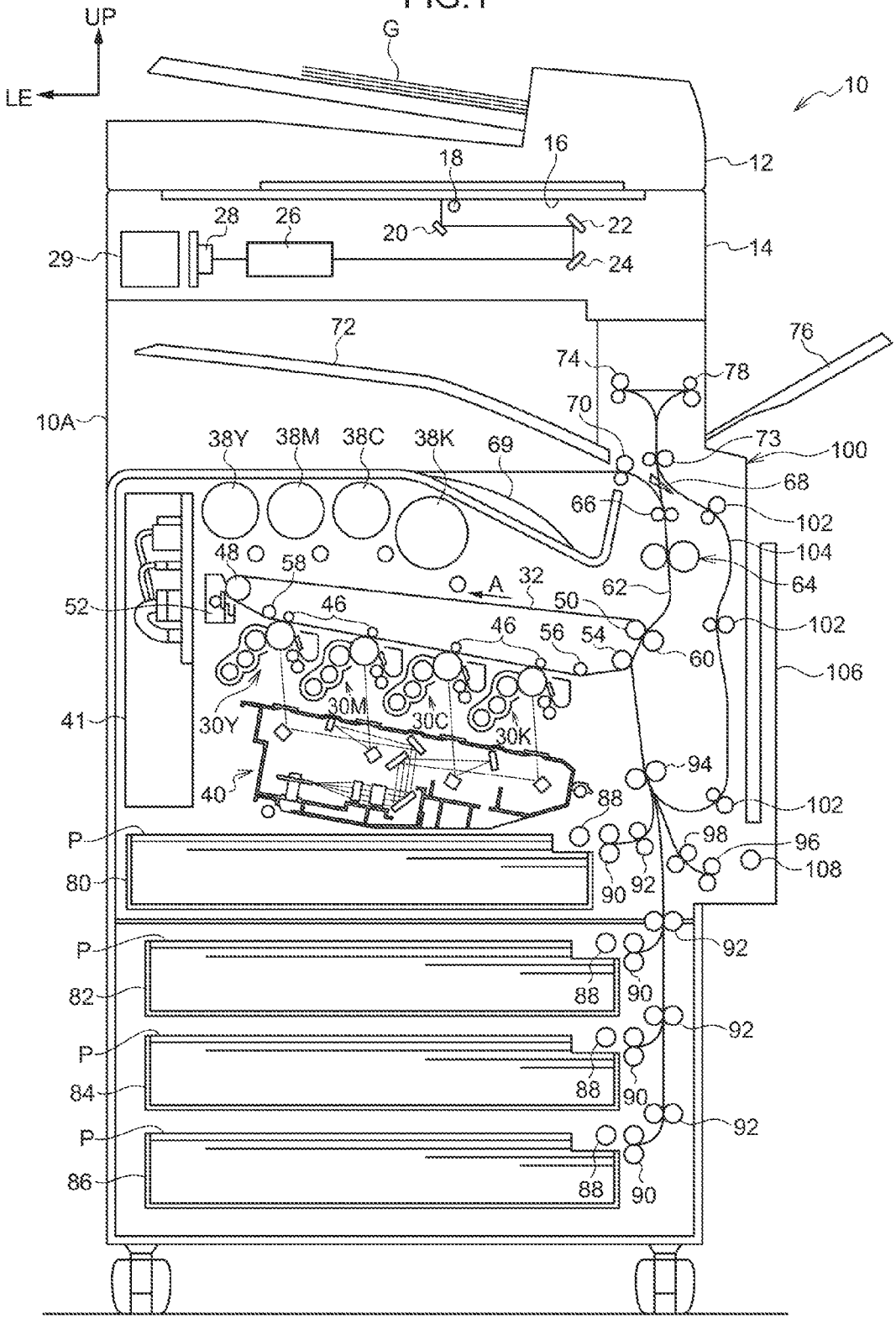
FIG. 1 is a view schematically showing a general configuration of an image forming apparatus according to the exemplary embodiment.

A detailed description will be given below of an exemplary embodiment according to the present invention with reference to the attached drawings. In FIG. 1, an arrow UP indicates an upward direction of an image forming apparatus 10 whereas another arrow LE indicates a leftward direction of the image forming apparatus 10. A drawing sheet vertical direction front side (near side) in FIG. 1 is referred to as the fore side of the image forming apparatus 10, and indicates the front. Here, a recording sheet P is adopted as one example of a recording medium in the exemplary embodiment.

As shown in FIG. 1, the image forming apparatus 10 in the present exemplary embodiment includes, at an upper portion of an apparatus body 10A, an automatic document transport device (feeder) 12 which automatically transports (feeds) plural sheets of documents G one by one, a platen glass 16 on which one sheet of document G is placed, and a document reader 14 which reads the document G fed by the automatic document feeder 12 or the document G placed on the platen glass 16. The document reader 14 includes a light source 18 which irradiates the document G fed by the automatic document feeder 12 or the document G placed on the platen glass 16 with light.

The document reader 14 includes an optical system having a full-rate mirror 20 that reflects a reflection light, which is irradiated by the light source 18 and reflected on the document G, in a direction parallel to the platen glass 16, a half-rate mirror 22 that reflects a reflection light reflected by the full-rate mirror 20 downward, another half-rate mirror 24 that reflects a reflection light reflected by the half-rate mirror 22 in the direction parallel to the platen glass 16 to return the light, and an imaging lens 26 into which a reflection light returned by the half-rate mirror 24 is incident.

The document reader 14 includes an optoelectronic converting element (transducer) 28 that converts the reflection light imaged by the imaging lens 26 into an electric signal, and an image processor 29 that performs image processing on the electric signal converted by the optoelectronic transducer 28. Here, the light source 18, the full-rate mirror 20, the half-rate mirror 22, and the other half-rate mirror 24 can be moved along the platen glass 16.

In a case where the document G placed on the platen glass 16 is read, the light source 18 irradiates the document G placed on the platen glass 16 with the light while the light source 18, the full-rate mirror 20, the half-rate mirror 22, and the other half-rate mirror 24 are moved, so that the reflection light reflected on the document G is imaged onto the optoelectronic transducer 28.

On the other hand, in a case where the document G fed by the automatic document feeder 12 is read, the light source 18 irradiates the document G fed by the automatic document feeder 12 with the light while the light source 18, the full-rate mirror 20, the half-rate mirror 22, and the other half-rate mirror 24 are stopped at predetermined positions, so that the reflection light reflected on the document G is imaged onto the optoelectronic transducer 28.

At the lower portion of the apparatus body 10A, sheet feeders 80, 82, 84, and 86 that accommodate recording sheets P of various sizes are disposed. A sheet supply roll 88 that feeds out the recording sheet P accommodated on each of the sheet feeders 80, 82, 84, and 86 to a transport path 62 from each of the sheet feeders 80, 82, 84, and 86 is disposed in each of the sheet feeder 80, 82, 84, and 86.

A pair of transport rolls 90 and another pair of transport rolls 92 that transport the recording sheets P one by one are respectively provided on a transport direction downstream side of the sheet supply rolls 88. A pair of positioning rolls 94 which temporarily stop the recording sheet P and then feed the recording sheet P at a predetermined timing to a second transfer position, which will be described later, are disposed in the transport direction downstream side of the feed rolls 92.

In the meantime, at the up and down direction substantial center portion of the apparatus body 10A, plural (i.e., four) image forming units 30Y, 30M, 30C, and 30K, which are example of image forming units, forming toner images of yellow (Y), magenta (M), cyan (C), and black (K) are provided to be arranged in this order at predetermined intervals from the left side in FIG. 1 in a state where the arranged-line of the units is inclined at predetermined angle with respect to a horizontal direction.

Specifically, the image forming unit 30Y for forming a yellow (Y) toner image which is first transferred onto an intermediate transfer belt 32, which will be described later, is located at a highest position whereas the image forming unit 30K for forming a black (K) toner image which is last transferred onto the intermediate transfer belt 32 is located at a lowest position.

Above the image forming units 30Y, 30M, 30C, and 30K, the endless intermediate transfer belt 32 wound around a drive roll 48 which drive-rotates the belt, a support roll 50 which rotates in driven-manner, a tension applying roll 54 that applies a tension, a first idler roll 56, and a second idler roll 58 is disposed. While the intermediate transfer belt 32 is circularly driven in an arrow A direction, the toner images formed by the image forming units 30Y, 30M, 30C, and 30K are first-transferred onto the intermediate transfer belt 32.

Figure 2:
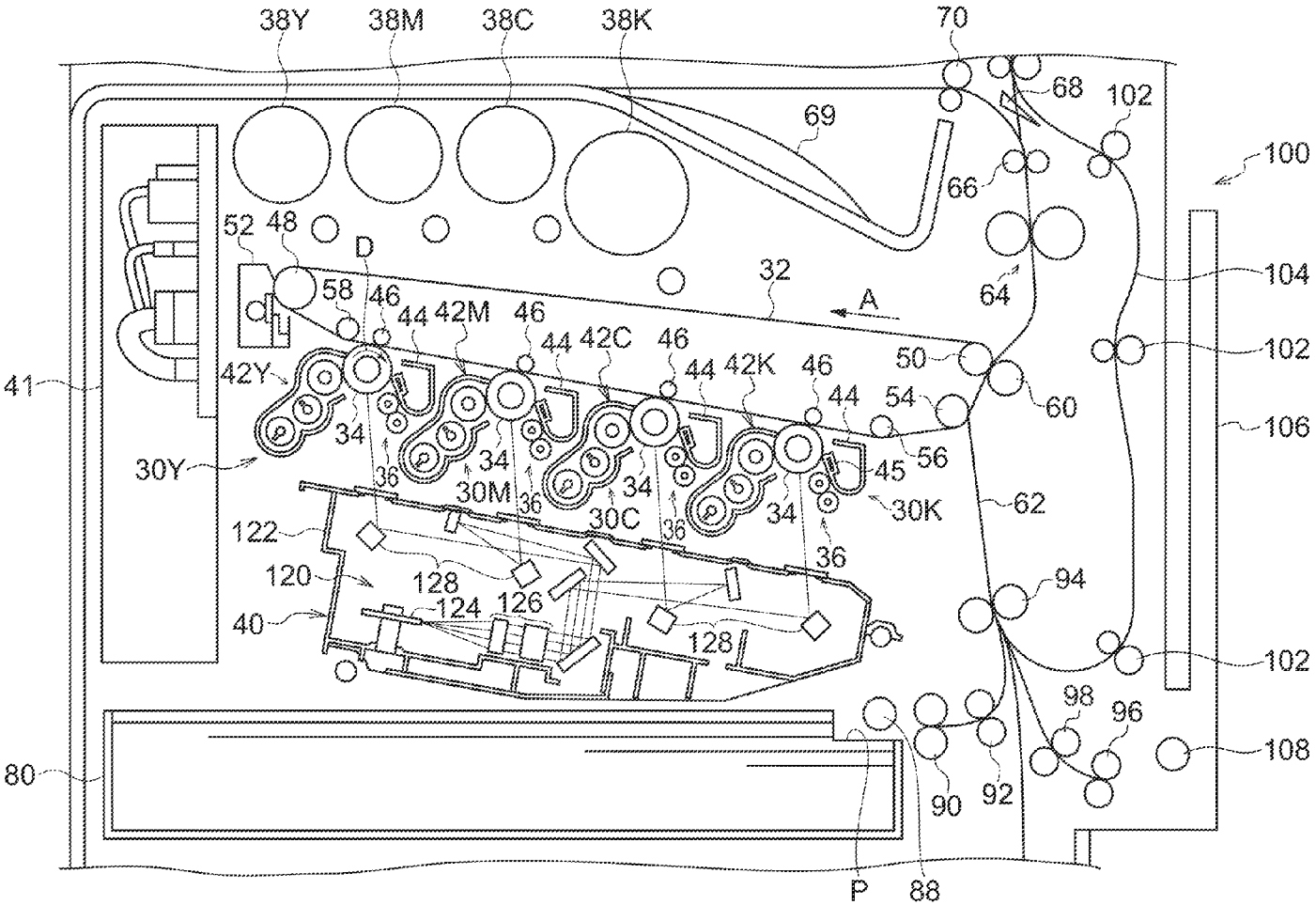
FIG. 2 is a view schematically showing a configuration of an image forming unit in the image forming apparatus according to the exemplary embodiment.

As shown in FIG. 2, each of the image forming units 30Y, 30M, 30C, and 30K for the respective colors includes a photoreceptor 34, which is example of an image carrier, to be rotated in an arrow D direction by a drive unit which is not shown in the drawings, and a charging member 36 that uniformly charges the surface of the photoreceptor 34. Moreover, an exposing unit 40 that exposes the surfaces of the photoreceptor drums 34 uniformly charged by the respective charging members 36 with lights corresponding to the respective colors so as to form respective electrostatic latent images is disposed under the image forming units 30Y, 30M, 30C, and 30K with being inclined along the image forming units 30Y, 30M, 30C, and 30K.

Inside of a casing 122 of the exposing unit 40, an optical system 120 that irradiates the photoreceptor drums 34 for the respective colors with lights so as to expose the surfaces with the lights is housed. The optical system 120 includes a light source, which is not shown in the drawings, that emits a light, a polygon mirror 124 which is a rotating polygonal mirror that reflects and deflects the light emitted from the light source, lenses 126 that allows the light reflected by the polygon mirror 124 to pass therethrough, and mirrors 128 that reflect the lights passing through the lenses 126 so as to expose the respective surfaces of the photosensitive drums 34 with the lights.

In each of the image forming units 30Y, 30M, 30C, and 30K for the respective colors, a developing device 42 which is example of a developing device that develops the electrostatic latent image formed on the surface of photoreceptor 34 with each color toner so as to visualize the image is disposed on a rotational direction downstream side of the photoreceptor 34 with respect to the charging member 36. A power source 41 that supplies electric power to the image forming units 30 and the like is provided on the left side of the image forming unit 30Y.

First transfer rolls 46 for transferring the toner images formed on the respective surfaces of the photoreceptor drums 34 onto the intermediate transfer belt 32 are disposed on the sides opposite to the respective photoreceptor drums 34 with the intermediate transfer belt 32 therebetween. In each of the image forming units 30Y, 30M, 30C, and 30K for the colors, a cleaner 44 that cleans a residual toner or the like remained on the photosensitive photoreceptor 34, which is not transferred onto the intermediate transfer belt 32 from the photosensitive photoreceptor 34, is disposed in the rotational direction downstream side of the photoreceptor 34 with respect to the first transfer roll 46.

Figure 4:
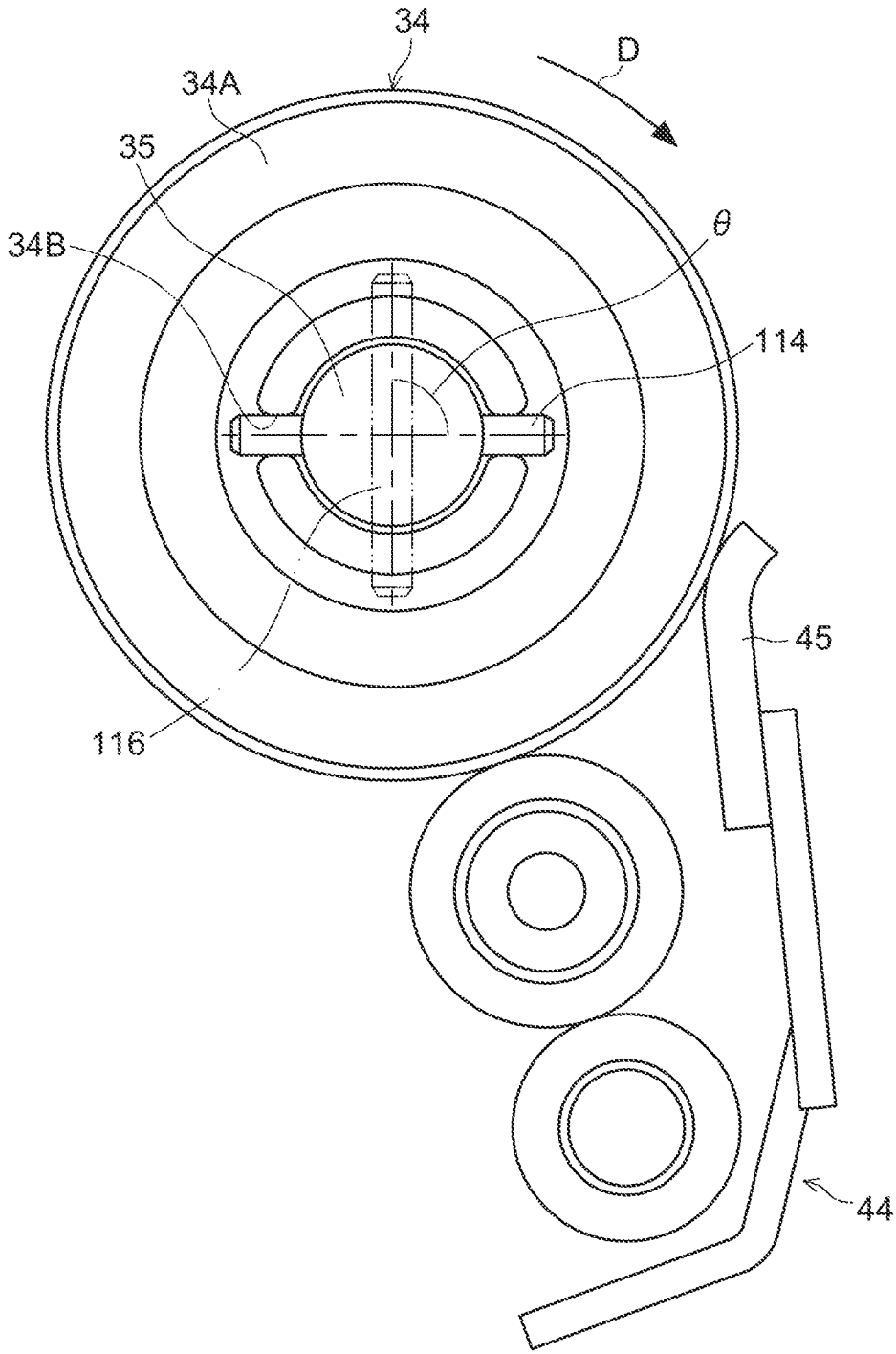
FIG. 4 is a view schematically showing the positional relationship between a engaging pin and a fixing pin as viewed in a rotary shaft direction of the photoreceptor according to the exemplary embodiment.

As shown in FIG. 4, the cleaner 44 includes a cleaning blade 45 which is example of a cleaning member. The cleaning blade 45 is made of an elastic material such as rubber, and the like, and the cleaning blade 45 is brought into press-contact with a surface of a photoreceptor body 34A of each of the photoreceptor drums 34 with a predetermined pressure and at a predetermined angle (i.e., the surface of the photoreceptor body 34A is pressed and pushed by the cleaning blade 45).

Above the intermediate transfer belt 32, toner cartridges 38Y, 38M, 38C, and 38K supplying toners of the respective colors to the respective developing devices 42 for the yellow (Y), magenta (M), cyan (C), and black (K) colors are provided. Here, the toner cartridge 38K containing the black (K) toner therein is fabricated larger than the other toner cartridges because the black (K) toner is frequently used.

A cleaning device 52 that cleans the surface of the intermediate transfer belt 32 is disposed opposite to the drive roll 48 with the intermediate transfer belt 32 being therebetween. A second transfer roll 60 that second-transfers the toner image which is first-transferred onto the intermediate transfer belt 32 onto the recording sheet P is disposed opposite to the support roll 50 with the intermediate transfer belt 32 being therebetween. In other words, a position defined between the second transfer roll 60 and the support roll 50 serves as a second transfer position at which the toner image is transferred onto the recording sheet P.

Above the second transfer roll 60 (i.e., at the downstream side of the transport direction of the recording sheet P), a fixing unit 64 that fixes the toner image transferred onto the recording sheet P at the second transfer position onto the recording sheet P is disposed. A pair of transport rolls 66 transporting the recording sheet P having the toner image fixed thereonto are disposed at the downstream side of the transport direction of the recording sheet P with respect to the fixing unit 64, and a switch gate 68 switching the transport direction of the recording sheet P is disposed at the downstream side of the transport direction of the recording sheet P with respect to the feed rolls 66.

First discharge rolls 70 discharging the recording sheet P which is guided by the switch gate 68 switched in one direction to a first discharge portion 69 are disposed on the transport direction downstream side of the switch gate 68. On the transport direction downstream side of the switch gate 68, second discharge rolls 74 and third discharge rolls 78 are provided to discharge the recording sheet P which is guided by the switch gate 68 switched in the other direction and transported by feed rolls 73 to a second discharge portion 72 and to a third discharge portion 76, respectively.

A duplex (both-sides) transport unit 100 that reverses and transports the recording sheet P in a case where images are formed on both sides of the recording sheet P is disposed at the right side of the second transfer position. The duplex feed unit 100 is provided with a reversal path 104, into which the recording sheet P transported by reverse-rotating of the feed rolls 73 is fed. Moreover, plural transport rolls 102 are disposed along the reversal path 104. The recording sheet P transported by the feed rolls 102 is transported again to the positioning rolls 94 in a reversed state.

A manual sheet supply unit 106 of a foldable type is disposed rightward side of the duplex feed unit 100. A sheet supply roll 108 and transport rolls 96 and 98 that transport the recording sheet P supplied from the opened manual sheet supply unit 106 of the foldable type are disposed downward side of the reverse path 104. The recording sheet P transported by the transport rolls 96 and 98 is transported to the positioning rolls 94.

Figure 3A:
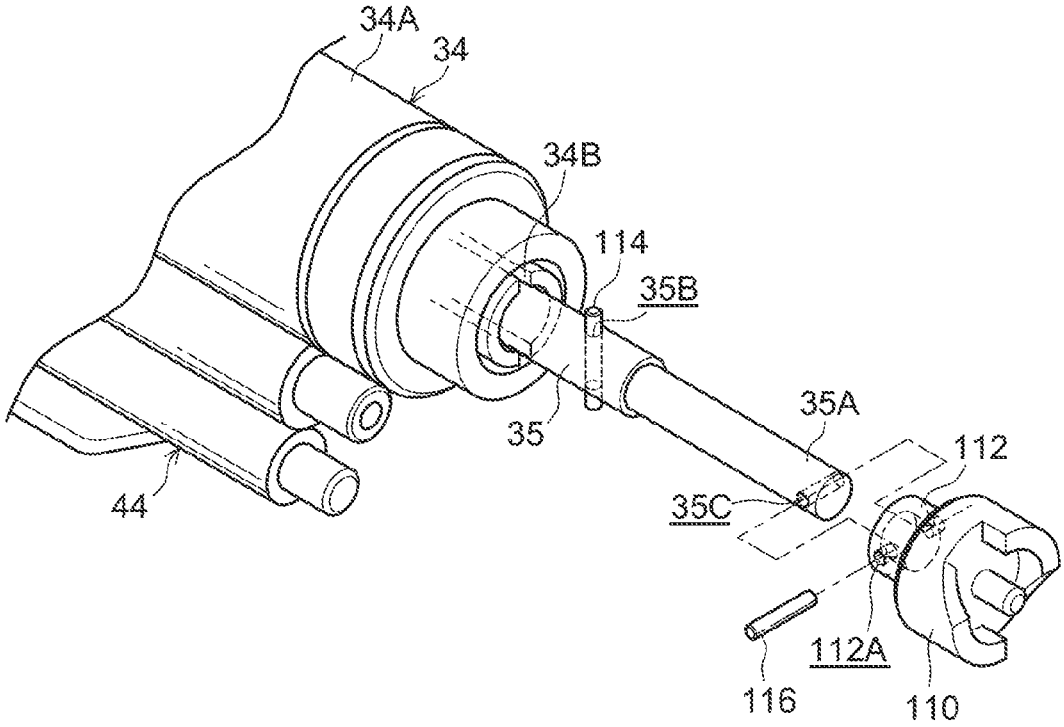
FIGS. 3A and 3B are schematic perspective views showing a configuration on one end portion side of a photoreceptor according to the exemplary embodiment.
Figure 3B:
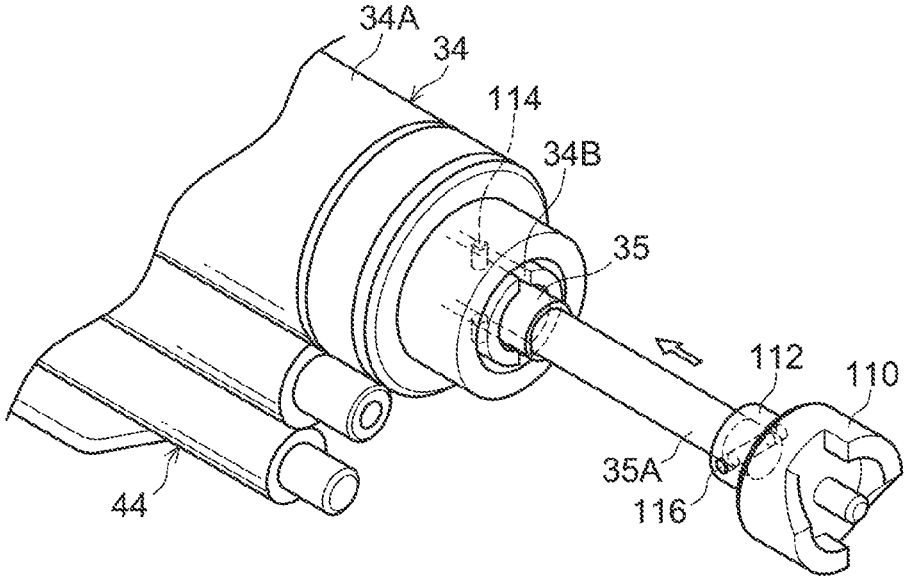

In the image forming apparatus 10 having the above-described configuration, a detailed description will be given of the configuration of the photoreceptor 34. As shown in FIGS. 3A and 3B, the photoreceptor 34 includes the cylindrical photoreceptor body (a photoreceptor drum) 34A on whose surface (circumferential surface) the electrostatic latent image is formed, and a rotary shaft (a drum shaft) 35 which is inserted into the center axial portion (a hollow portion) of the photoreceptor body 34A and rotatably supports the photoreceptor body 34A.

The photosensitive photoreceptor 34 includes an engaging pin 114 which is example of an engaging member. The engaging pin 114 is attached to the rotary shaft 35 by the engaging pin 114 being press-fitted into (i.e., inserted into and fixed to) a through hole 35B formed in the rotary shaft 35 in a direction perpendicular to the axial direction of the rotary shaft 35 such that both end portions of the engaging pin 114 project in directions opposite to each other from the circumferential surface of the rotary shaft 35. The engaging pin 114 is formed so as to have a greater length than a diameter of the rotary shaft 35.

The engaging pin 114 (the both end portions of the engaging pin 114) is fitted (entered), from the axial direction, to a slit portion (i.e., a groove portion) 34B which is example of an engaged portion, formed in the photoreceptor body 34A, to be engaged in the circumferential direction. In this configuration, the photoreceptor body 34A cannot be rotated relatively to the rotary shaft 35. In other words, the photoreceptor body 34A is rotated together with the rotation of the rotary shaft 35.

A coupling member 110 which is example of a coupling member for transmitting a rotational drive force from the side of the apparatus body 10A to the rotary shaft 35 is provided to be attached to one end portion 35A of the rotary shaft 35. A cylindrical (tube) portion 112 of the coupling member 110 is fitted to the one end portion 35A of the rotary shaft 35 from the outer side (the one end portion 35A of the rotary shaft 35 is inserted inside the cylindrical (tube) portion 112), and is attached by an attaching pin 116 which is example of an attaching member, which will be described later.

Specifically, a through hole 112A is formed in the cylindrical portion 112 in the direction perpendicular to the axial direction, and another through hole 35C is formed in the one end portion 35A of the rotary shaft 35 in the direction perpendicular to the axial direction. The attaching pin 116 having a greater length than the diameter of the rotary shaft 35 is continuously press-fitted into (i.e., inserted into and fixed to) the through hole 112A and the through hole 35C formed, so that the coupling member 110 is attached to the rotary shaft 35.

As shown in FIG. 4, the angle θ formed between the engaging pin 114 and the attaching pin 116 is set to substantially 90 degrees (θ is substantially equal to 90°), as seen in the axial direction of the rotary shaft 35. In other words, penetration directions of the through holes 35B and 35C formed in the rotary shaft 35 deviate (are different) from each other at substantially 90°, as seen in the axial direction of the rotary shaft 35.

In the photoreceptor 34 having the above-described configuration, the operation will be explained below. First, image data of the yellow (Y), magenta (M), cyan (C), and black (K) colors are sequentially output into the exposing device 40 from the image processor 29 or the outside. The surface of the photoreceptor 34 (i.e., the photoreceptor body 34A) corresponding to each color is exposed with the light emitted from the exposing device 40 based on the image data, and an electrostatic latent image is formed thereon.

The electrostatic latent image formed on the photoreceptor 34 is developed as a toner image of each of the yellow (Y), magenta (M), cyan (C), and black (K) colors by each of the developing devices 42Y, 42M, 42C, and 42K. And then, the toner images of the yellow (Y), magenta (M), cyan (C), and black (K) colors sequentially formed on the photoreceptor 34 are transferred in superimposition manner onto the intermediate transfer belt 32 arranged upwardly with respect to the image forming units 30Y, 30M, 30C, and 30K with and inclined, by the first transfer rolls 46.

At this time, in the photoreceptor 34, the angle θ formed between the engaging pin 114 and the attaching pin 116 is set to substantially 90 degrees (θ is substantially equal to 90°), as seen in the axial direction of the rotary shaft 35. Accordingly, simultaneous occurrence of a (slight) looseness of the photoreceptor body 34A and the rotary shaft 35 caused by gap(s) in a circumferential direction between the slit 34B and the engaging pin 114 and a (slight) looseness of the coupling member 110 and the rotary shaft 35 caused by gap(s) in a circumferential direction between the through holes 35C and 112A, and the attaching pin 116 does not occur.

The cleaning blade 45 press-contacts onto the photoreceptor body 34A with the predetermined pressure and at the predetermined angle (i.e., the cleaning blade 45 pushes and presses the surface of the photoreceptor body 34A). Consequently, a circumferential velocity fluctuation (i.e., a rotational variation) is liable to occur at the photoreceptor 34 due to the looseness between the slit 34B formed at the photoreceptor body 34A and the engaging pin 114.

In addition, the rotational drive force from the drive source, which is not shown in the drawings, disposed in the apparatus body 10A is transmitted to the coupling member 110. Therefore, a circumferential velocity fluctuation (i.e., a rotational variation) is liable to occur at the photoreceptor 34 due to the looseness between the through hole 112A formed in the cylindrical portion 112 and the through hole 35C formed in the rotary shaft 35, and the attaching pin 116.

However, in the exemplary embodiment, since the penetration directions of the engaging pin 114 and the attaching pin 116 are displaced in phase from each other at substantially 90°, the loosenesses influencing color displacement (i.e., image displacement) at each of portions of the engaging pin 114 and the attaching pin 116 do not occur at the same time. In this manner, the color displacement due to the circumferential velocity fluctuation at each of the photosensitive drums 34 caused by precision of parts (i.e., the assembling precision between the photoreceptor body 34A and the rotary shaft 35 and the assembling precision between the coupling member 110 and the rotary shaft 35) can be suppressed.

A description will be given in further details with reference to the graphs of FIGS. 5A, 5B, 6A, and 6B. FIGS. 6A and 6B show a comparative example. In the photoreceptor 34 shown in the comparative examples, although not shown in the drawings, the angle θ formed between the engaging pin 114 and the attaching pin 116 is set to 0°, as seen in the axial direction of a rotary shaft 35. That is to say, the engaging pin 114 and the attaching pin 116 are press-fitted in parallel to each other in the same direction.

As illustrated in FIG. 6A, a peak of the circumferential velocity fluctuation caused by the looseness between the photoreceptor body 34A and the rotary shaft 35 overlaps a peak of the circumferential velocity fluctuation caused by the looseness between the coupling member 110 and the rotary shaft 35. In other words, the looseness between the photoreceptor body 34A and the rotary shaft 35 and the looseness between the coupling member 110 and the rotary shaft 35 occur at the same time.

If the engaging pin 114 is inserted (i.e., fitted) into the slit 34B in a state where the rotary shaft 35 is rotated with 180° from the state as shown in FIG. 6A (that is, in a case of reversal pin phase at 180 degrees), as illustrated in FIG. 6B, similar phenomenon is shown. Here, the looseness illustrated in FIG. 6B is larger than that illustrated in FIG. 6A. It is usually difficult to assemble by distinguishing the state of the photoreceptor 34 illustrated in FIG. 6A and the state of the photoreceptor 34 illustrated in FIG. 6B. In general, both states are mixed in a single image forming apparatus 10. As a result, color displacement caused by the circumferential velocity fluctuation of each of the photoreceptors 34 possibly becomes larger (i.e., conspicuous).

Figure 5A:
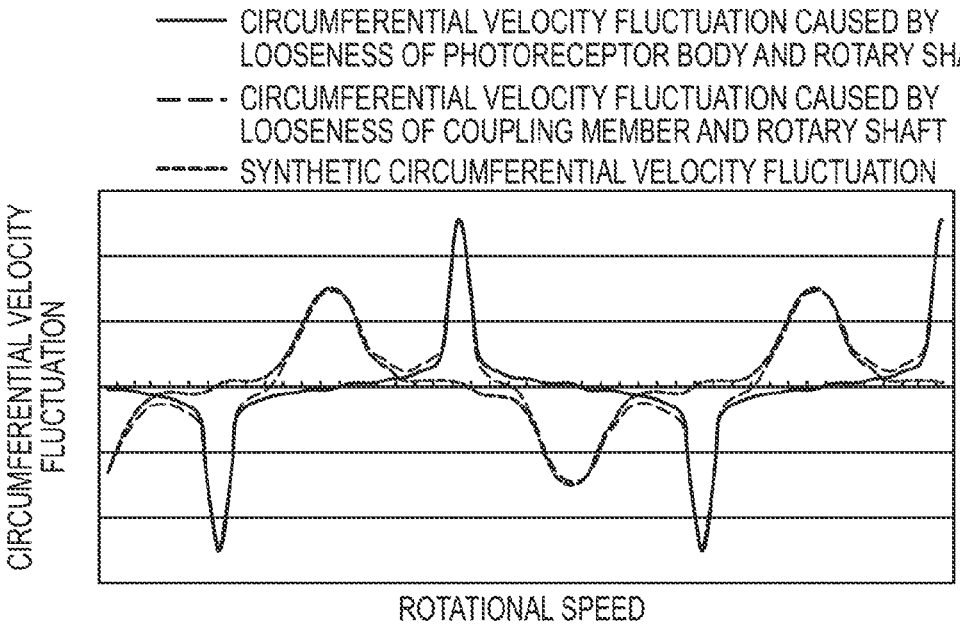
FIGS. 5A and 5B are graphs illustrating circumferential velocity fluctuations of the photoreceptor according to the exemplary embodiment.
Figure 6A:
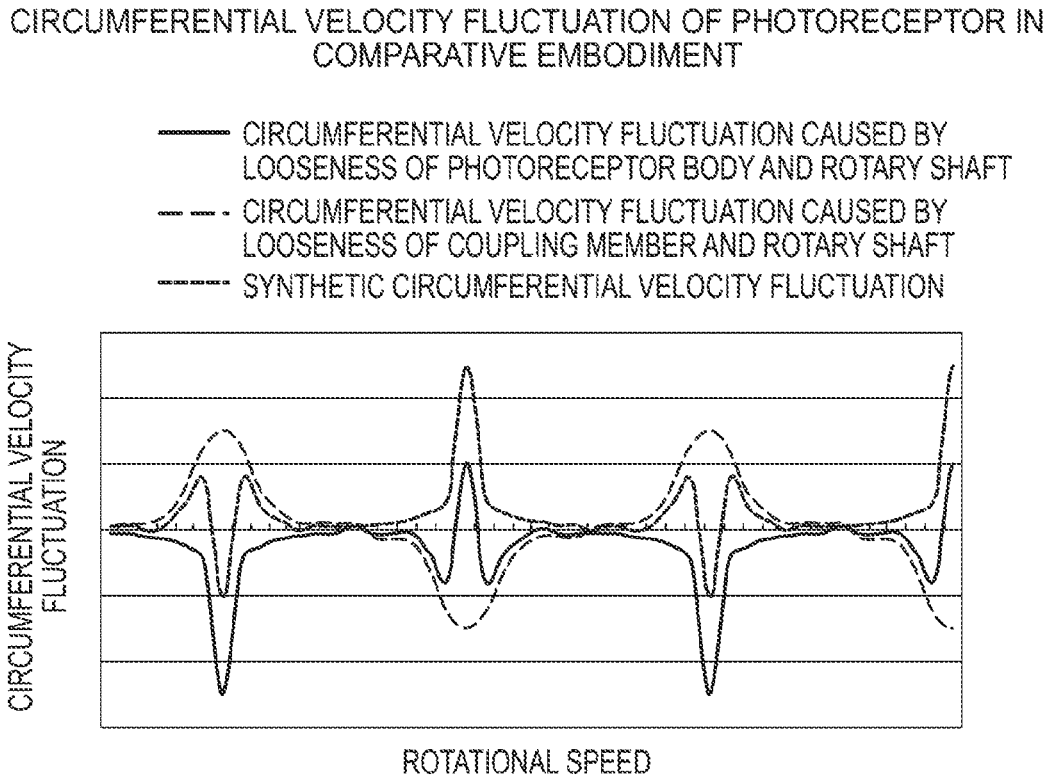
FIGS. 6A and 6B are graphs illustrating circumferential velocity fluctuations of a photoreceptor in a comparative example.
Figure 6B:
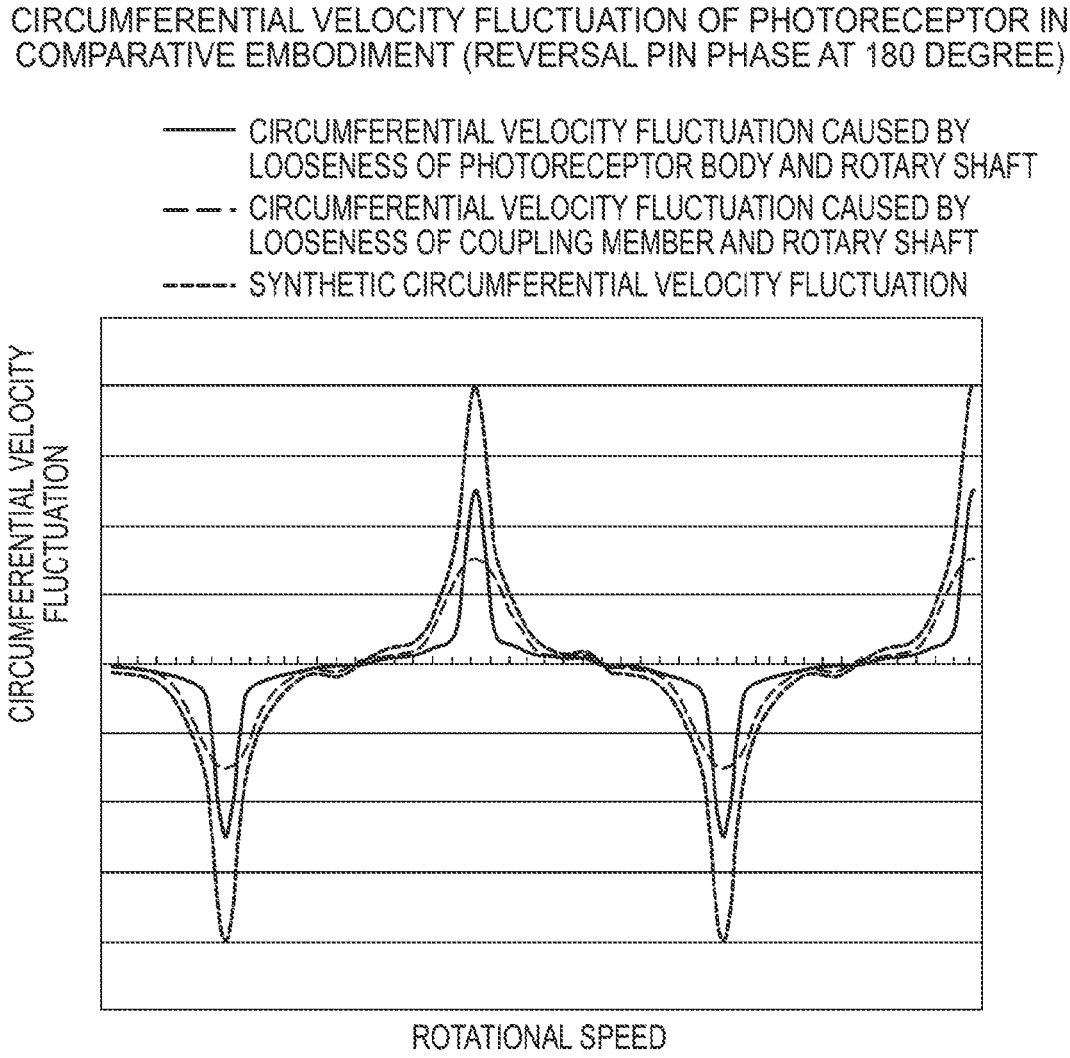

To the contrary, in the photoreceptor 34 in the present exemplary embodiment, the peak of the circumferential velocity fluctuation caused by the looseness between the photoreceptor body 34A and the rotary shaft 35 does not overlap the peak of the circumferential velocity fluctuation caused by the looseness between the coupling member 110 and the rotary shaft 35 (i.e., the peaks are displaced each other within a half of period of peak), as illustrated in FIG. 5A. In other words, the looseness between the photoreceptor body 34A and the rotary shaft 35 and the looseness between the coupling member 110 and the rotary shaft 35 do not occur at the same time in the photoreceptor 34 in the present exemplary embodiment.

Figure 5B:
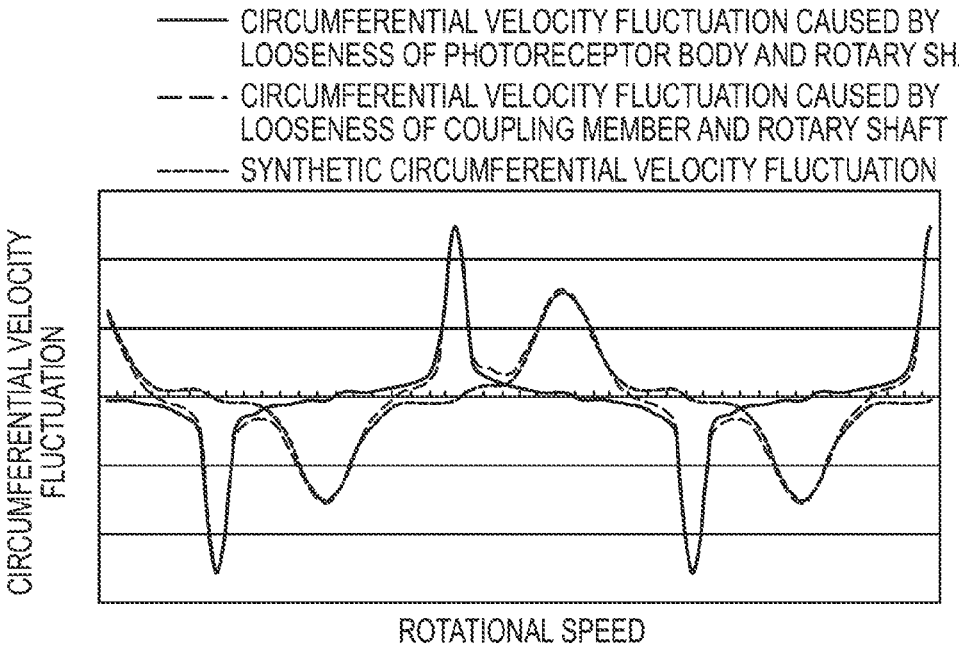

If the engaging pin 114 is inserted (i.e., fitted) into the slit 34B in a state where the rotary shaft 35 is rotated with 180° from the state as shown in FIG. 5A (that is, in a case of reversal pin phase at 180 degrees), as illustrated in FIG. 5B, similar phenomenon is shown. In addition, in the photoreceptor 34 in the present exemplary embodiment, there is no (substantially) difference in circumferential velocity fluctuation values between the state illustrated in FIG. 5A and the state illustrated in FIG. 5B (in comparison with the states illustrated in FIGS. 6A and 6B). As a result, color displacement caused by the circumferential velocity fluctuation can be suppressed even if the photoreceptors 34 illustrated in FIGS. 5A and 5B are mixed (in the single image forming apparatus 10) compared with a case shown in FIGS. 6A and 6B.

Incidentally, since the engaging pin 114 is attached to the rotary shaft 35 by press-fitting in advance, and then, in this state, the engaging pin 114 is inserted into the slit 34B, assembling property of the photoreceptor 34 and recyclability in disassembling of the photoreceptor 34 can be enhanced. Additionally, the through-holes 35B and 35C are merely formed at the rotary shaft 35 with being substantially 90° displaced each other as seen in the axial direction of the rotary shaft 35 in the photoreceptor 34, so, complicated shape and structure of the parts are not necessary. Thus, the photoreceptor 34 can be configured with a reduced cost. Moreover, the surroundings of the photoreceptor 34 may be configured in a space-saving manner, and therefore, consumable parts may be safely exchanged with new parts in the image forming unit 30.

Although the image forming apparatus 10 in the present exemplary embodiment has been described by way of the exemplary embodiment shown in the drawings, the image forming apparatus 10 in the present exemplary embodiment is not limited to the exemplary embodiment shown in the drawings. For example, the configuration of the engaging pin 114 is not limited to a pin being press-fitted into and attached to the through hole 35B, may be attached at the circumferential surface of the rotary shaft 35 by welding or the like in such a manner as to project from the circumferential surface of the rotary shaft 35 in directions opposite to each other. Alternatively, the image carrier in the present exemplary embodiment is applied not only to the photoreceptor 34 shown in the drawings but also to a transfer drum, not shown, or the like in the same manner.

What is claimed is:

1. An image forming apparatus comprising:

an image carrier;

a rotary shaft that is inserted in the image carrier, and that rotatably supports the image carrier;

a coupling member that is provided to be fitted to an end portion of the rotary shaft, and that transmits a rotational drive force to the rotary shaft;

a first engaging member that projects from a circumferential surface of the rotary shaft and engages with a first groove formed in the image carrier so as to disable relative rotation of the image carrier with respect to the rotary shaft; and a second engaging member that projects from the circumferential surface of the rotary shaft and engages with a second groove formed in the coupling member, wherein the first engaging member projects in a first direction that crosses an axial direction of the shaft, the second engaging member projects in a second direction that crosses the first direction.

2. The image forming apparatus of claim 1, further comprising a cleaning member that contacts the surface of the image carrier, and cleans the surface.

3. The image forming apparatus of claim 1, wherein: a first through hole and a second through hole are formed in the rotary shaft, penetration directions of the first through hole and the second through hole are orthogonal to the axial direction of the rotary shaft.

4. The image forming apparatus of claim 3, wherein the first engaging member is inserted into the first through hole and is fixed thereto such that both end portions of the first engaging member project from the circumferential surface of the rotary shaft in directions opposite to each other.

5. The image forming apparatus of claim 3, wherein the first engaging member is a pin having a length longer than a diameter of the rotary shaft.

6. The image forming apparatus of claim 4, wherein both end portions of the first engaging member are engaged with the first groove.

7. The image forming apparatus of claim 1, wherein a cylindrical portion is formed at an end portion of the coupling member, and the second groove is formed in the end portion.

8. The image forming apparatus of claim 1, wherein the second engaging member is a pin.

9. An image forming apparatus comprising:

an image carrier;

a rotary shaft that is inserted in the image carrier, and that rotatably supports the image carrier;

a coupling member that is provided to be fitted to an end portion of the rotary shaft, and that transmits a rotational drive force to the rotary shaft;

a first engaging member that is inserted into a first through hole formed in the rotary shaft, and both end portions of the first engaging member project from a circumferential surface of the rotary shaft in directions opposite to each other, the both end portions being engaged to an engaged portion formed in the image carrier body; and a second engaging member that is inserted into a third through hole formed in the coupling member and a second through hole formed in the rotary shaft and first engaging member and the second engaging member cross each other when viewed along an axial direction of the rotary shaft, the second engaging member engages the coupling member and the rotary shaft.

10. The image forming apparatus of claim 1, wherein an angle between the first direction and the second direction is substantially 90 degrees in a rotation direction of the shaft.

11. The image forming apparatus of claim 1, wherein the first engaging member is disposed at a different position along the axial direction of the shaft than the second engaging member.

12. The image forming apparatus of claim 1, wherein the rotary shaft is formed of a single member.

13. The image forming apparatus of claim 3, wherein the first engaging member is inserted into the first through hole and the second engaging member is inserted into the second through hole.

14. The image forming apparatus of claim 9, wherein an angle between the first engaging member and the second engaging member is substantially 90 degrees in a rotation direction of the shaft.

15. The image forming apparatus of claim 9, wherein the first engaging member is disposed at a different position along the axial direction of the shaft than the second engaging member.

16. The image forming apparatus of claim 9, wherein the first through hole is disposed at a different position along the axial direction of the shaft than the second through hole.

17. The image forming apparatus of claim 9, wherein the rotary shaft is formed of a single member.

* * * * *